US005988684A

United States Patent [19]

Blaustein et al.

[11] Patent Number: 5,988,684

[45] Date of Patent: Nov. 23, 1999

[54] MECHANIZED AND MOTORIZED BOOKS WITH INTERNAL MECHANISM FOR SELECTIVELY MOVING OBJECTS RELATIVE TO BOOK PAGES

[75] Inventors: Lawrence A. Blaustein, Moreland Hills; Jill Ann Tapper, Shaker Hts.; Jerzy Perkitny, Moreland Hills, all of Ohio

[73] Assignee: Lawrence Product Development, Cleveland, Ohio

[21] Appl. No.: 08/924,962

[22] Filed: Sep. 8, 1997

[51] Int. Cl.[6] ..... G09F 11/00; B42D 1/00

[52] U.S. Cl. ..... 281/15.1; 281/28; 281/38; 281/51; 434/365; 434/368; 446/147; 446/149; 446/150

[58] Field of Search ..... 281/38, 51, 28; 434/365, 368; 446/147, 149, 150

[56] References Cited

U.S. PATENT DOCUMENTS

| | | | |
|---|---|---|---|
| 622,111 | 3/1899 | Brentano . | |
| 1,201,913 | 10/1916 | Arnold . | |
| 1,988,045 | 1/1935 | Morris . | |
| 2,126,567 | 8/1938 | McCallum . | |
| 2,367,373 | 1/1945 | Ralston | 46/34 |
| 2,429,335 | 10/1947 | Wehr . | |
| 2,432,318 | 12/1947 | Leech . | |
| 2,500,106 | 3/1950 | Wehr | 46/119 |
| 2,884,724 | 5/1959 | Lohnes et al. . | |
| 2,895,244 | 7/1959 | Youngren . | |
| 3,142,919 | 8/1964 | Richardson . | |
| 3,318,040 | 5/1967 | Kinberg . | |
| 3,462,873 | 8/1969 | Moreci . | |
| 3,559,321 | 2/1971 | Helms . | |
| 3,994,091 | 11/1976 | Modell . | |
| 5,139,454 | 8/1992 | Earnest . | |
| 5,383,292 | 1/1995 | Whittredge . | |
| 5,494,445 | 2/1996 | Sekiguchi et al. . | |
| 5,548,913 | 8/1996 | Randolph et al. . | |
| 5,580,098 | 12/1996 | Gates . | |

*Primary Examiner*—Willmon Fridie, Jr.
*Assistant Examiner*—Mark T. Henderson
*Attorney, Agent, or Firm*—Calfee, Halter & Griswold LLP

[57] ABSTRACT

Books with internal mechanization have rotary and linear drive mechanisms which displace objects along linear, non-linear, rotary and three-dimensional paths relative to the book pages are described. Spatially arranged cut-outs in the pages which correspond to the range of motion of the displaced and translated objects allow different moving objects to be viewed at different areas of the book from page to page. Battery powered drive mechanisms with push-button operation accessible from the front of the book enables easy, selective activation of the moving objects, independent of the position of the front cover and pages relative to the back cover. Belt-driven wheels provide inherent clutching action to prevent damage to the drive mechanism. Manually operated embodiments of the various drive mechanisms which produce each of the described motions are also disclosed.

42 Claims, 8 Drawing Sheets

MECHANIZED AND MOTORIZED BOOKS WITH INTERNAL MECHANISM FOR SELECTIVELY MOVING OBJECTS RELATIVE TO BOOK PAGES

FIELD OF THE INVENTION

The present invention pertains generally to books and, more particularly, to specialized books with integral electrical and mechanical systems which perform functions related to the printed subject matter of a book.

BACKGROUND OF THE INVENTION

Childrens' books have been enhanced in many different ways to bring animation, dimension and action to the story told by the printed media. Some early examples are the well-known "pop-up" type books having extra layers of page material which are erected into a static structure out of the plane of opposing pages upon opening of the book, or by manipulation of movable pieces within the pages. Different materials, such as fabric, reflective foil and plastics have been attached to book pages. More recently, certain forms of non-printed media, such as sound and light generating devices, have been mounted in book bindings and on the front or back cover with prominent push-button operation for easy activation. Although these types of books succeed in providing an element or aspect to the book in addition to the printed matter, they do not provide physical motion in connection with the book pages apart from the simple moving of the pages by the reader.

There have been many different approaches to creating physical motion of parts attached to generally planar book or card pages to animate the message of printed material. For example, U.S. Pat. No. 1,988,045 describes an advertising card with a lift tab which changes a traffic light from red to green, and simultaneously releases a cut-out figure of an automobile on a rubber band in tension, whereby the auto speeds across the frontal plane of the card on which it is mounted.

U.S. Pat. Nos. 2,432,318 and 2,429,335 describe simple cards or pages with sliding and pivoting members between front and back panels. Similarly, U.S. Pat. No. 2,884,724 describes a foldable greeting card with a movable panel on one of the pages of the card. And U.S. Pat. Nos. 2,895,244; 3,318,040 and 3,559,321 each disclose various cards with movable parts manually movable by an actuator tab or slide. In the inventions described by these patents, the range and type of motion of the moving parts is very limited, and entirely dependent upon manual actuation by the user.

Powered movement of objects relative to a planar surface such as a card or page has also been accomplished in several different ways. U.S. Pat. No. 2,500,106 describes an animated display which has a casing with one side covered by an illustrated front sheet. A motor inside the casing drives a disc and connecting rod to oscillate a sheet behind the front sheet. Illustrated pieces on the frontal surface of the front sheet are attached to the back sheet and thereby oscillated relative to the front sheet to simulate motion. The front sheet can be exchanged. U.S. Pat. No. 3,142,919 describes a single panel display with movable members mounted in front and attached to a motorized cam to produce swinging or rocking motion of the members across the front of the display. The display is not described or suggested for use in the bound format of a book. U.S. Pat. No. 5,139,454 describes a greeting card having a battery powered electrical circuit connected to a piezoelectric wire material which contracts with applied current to rotate a drive gear in a small gear train mounted on the card. Images applied to the gear faces are thereby rotated relative to openings in the card to provide animated motion. And U.S. Pat. No. 622,111 describes a type of covered box with which houses a spring-wound motor which drives a series of linkages supporting objects in relation to a single picture sheet. Opening the cover of the box winds up the motor which sets the linkages and objects in motion. There are no intermediate pages between the front cover and the back display to cover or expose any of the moving objects. In other words, upon opening the cover of the box, all of the moving components are immediately exposed. Also, opening of the cover sets the components into continuous motion until the motor completely winds down. The reader has no control over activation and deactivation of the moving components.

Although these inventions provide motion of objects relative to a planar surface, the manner or exposure and activation of the motion is limited, and therefore of little entertainment value, especially to young children. Also, each of these constructions is dependent upon delicate and fragile mechanisms to produce motion, making them unsuitable for prolonged use by children.

SUMMARY OF THE PRESENT INVENTION

The present invention provides automated books especially adapted for children. In accordance with one aspect of the invention, an automated book with movable objects movable and displaceable under power relative to planar pages of the book, the book having a binding connected to a front cover, a back cover and pages between the front cover and back cover, the back cover further having a motor, the motor in driving engagement with a main drive wheel mounted to rotate about an axis which extends from the back cover, one or more link arms attached to the main drive wheel, and objects attached to the link arms, the objects being set into motion relative to pages of the book by movement of the link arms upon rotation of the main drive wheel.

In accordance with another aspect of the invention, a mechanized book includes a front cover, intermediate pages and a back cover connected together along a common edge, and a motorized mechanism supported by the back cover and connected to objects and operable to move the objects in relation to the back cover, intermediate pages and front cover upon actuation of the drive mechanism, and openings in the intermediate pages which correspond in size to a range of motion of the objects.

And in accordance with another aspect of the invention is an automated book having an electrically powered mechanism for selectively setting objects into motion relative to pages of the book, the book including a front cover, a back cover, and intermediate pages between the front cover and back cover, the back cover supporting the electrically powered mechanism, objects connected to the electrically powered mechanism, linear directional slots in the back cover through which the objects travel upon activation of the electrically powered mechanism, and a rotary object rotated by the electrically powered mechanism and visible through an opening in the back cover.

And in accordance with still another aspect of the invention, there is provided a mechanized book having objects which move in relation to pages of the book, the book having a front cover attached to a back cover assembly, intermediate pages between the front cover and the back cover assembly, the back cover assembly including a frame surrounding a back cover plate and a back cover panel, the back cover panel parallel to and spaced from the back cover plate, an exterior side of the back cover panel facing the intermediate pages, a drive mechanism within the back cover assembly, the drive mechanism including a motor connected to members, directional guide slots in the back cover panel, and objects on the exterior side of the back cover panel connected by connecting pins which extend through the back cover panel to members of the drive mechanism, the directional guide slots defining a linear path which an intersecting connecting pin and connected object follows when a corresponding member of the drive mechanism is put into motion by the drive mechanism motor, whereby an object travels a linear path relative to the back cover panel, and at least one opening in an intermediate page which corresponds to a directional guide slot.

These and other novel and unobvious aspects of the invention are herein described in particularized detail with reference to the accompanying Figures which depict certain illustrative embodiments and alternate embodiments of the invention, these being indicative, however, of but a few of the various ways in which the invention may be employed.

DETAILED DESCRIPTION OF PREFERRED AND ALTERNATE EMBODIMENTS

Figure 1:
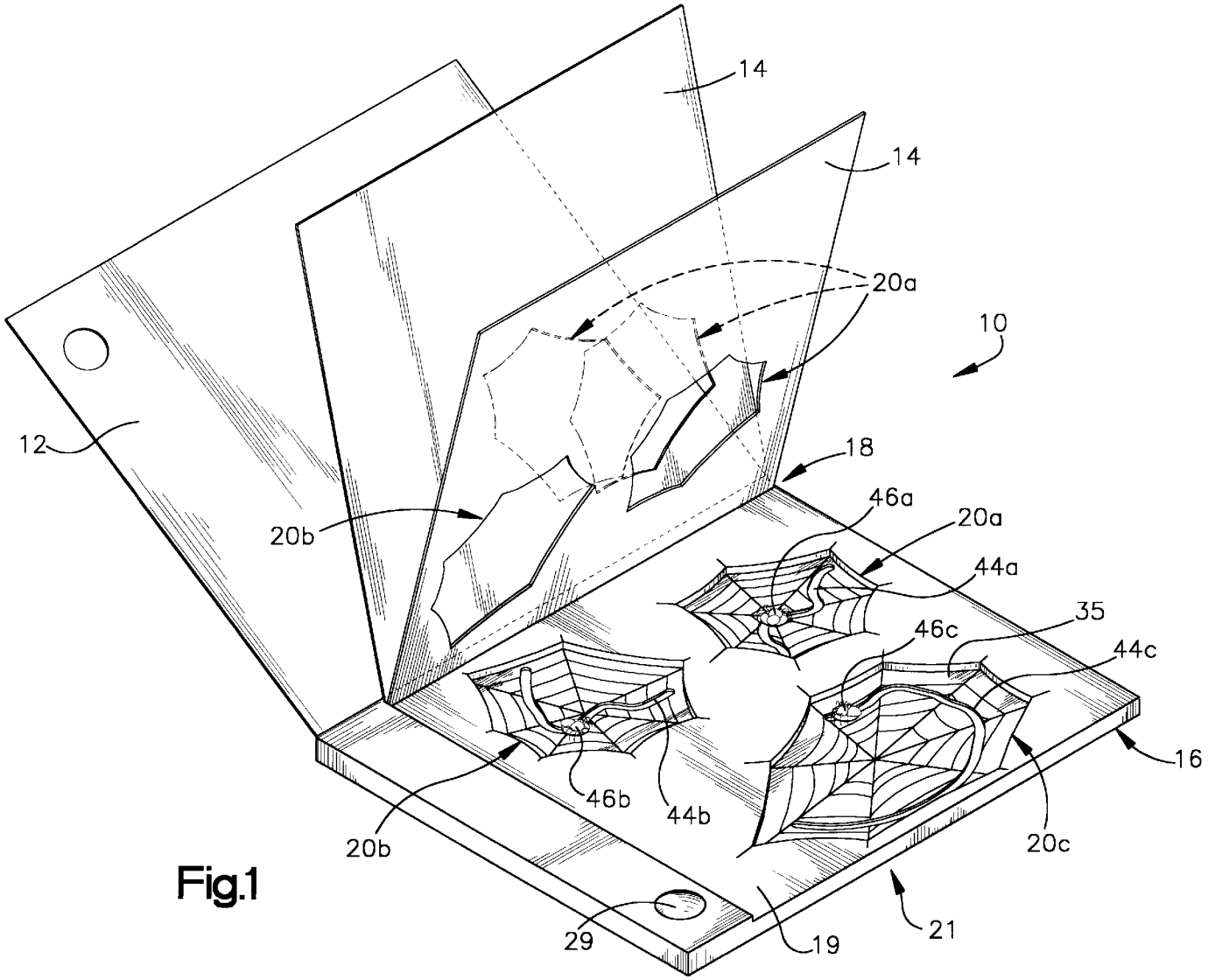
FIG. 1 is a perspective view of a mechanized book of the present invention.
Figure 1A:
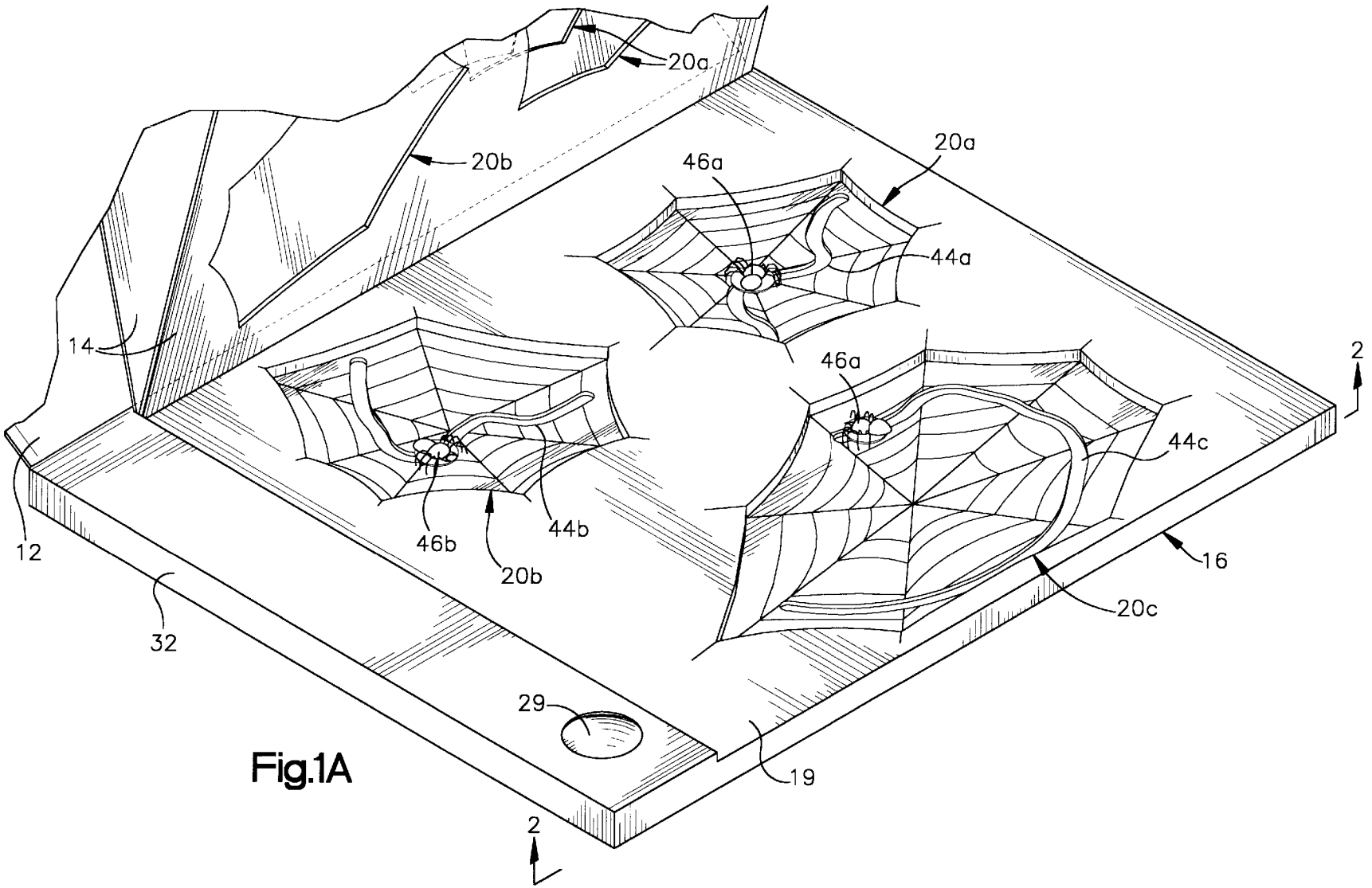
FIG. 1A is a perspective view of the back cover structure of a mechanized book of the present invention.

As shown in FIGS. 1 and 1A, one embodiment of a book of the invention having a mechanism for moving objects relative to the book pages is illustrated generally at 10. The book 10 includes a front cover 12, intermediate pages 14, and a back cover assembly 16. A binding 18 is located along the left edge though could be located along any other edge of the covers and pages in accordance with the invention. The front cover 12 and pages 14 include openings or cut-out areas 20*a–c* which, in the closed position, generally overlie an area of motion of an object projecting from the back cover assembly 16.

Figure 2:
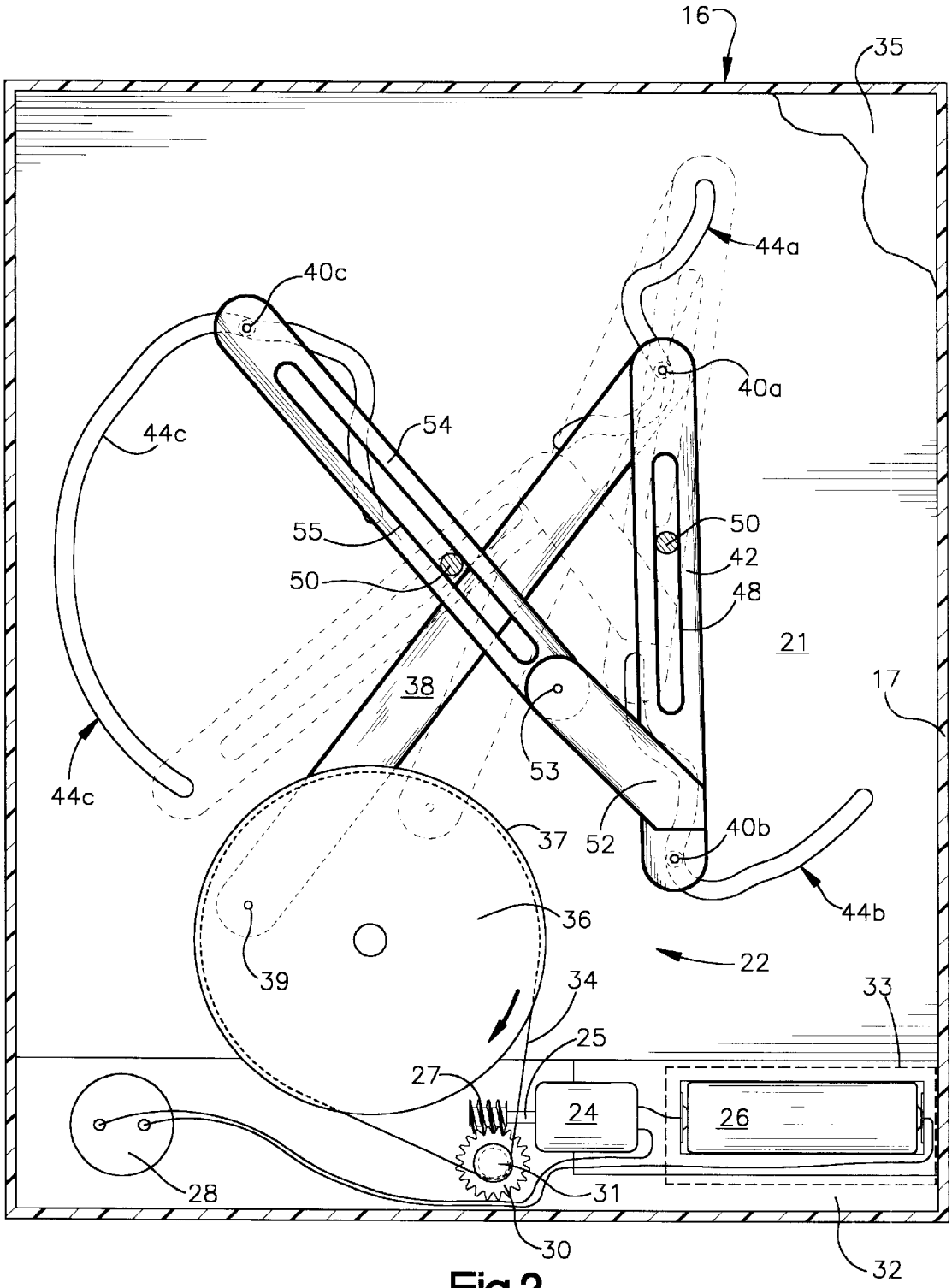
FIG. 2 is a plan view of an exterior side of the back cover structure and drive mechanism of the mechanized book of FIGS. 1 and 1A.

As further shown in FIG. 2, the back cover assembly 16 includes a back cover frame 17 which surrounds a back cover plate 21. A drive mechanism, indicated generally at 22, operative to move or translate or displace objects attached to elements of the drive mechanism relative to the back cover, front cover, and pages of the book, is attached to the back cover assembly. The drive mechanism 22 includes a motor 24, which may be a small DC motor connected to a battery 26, and a contact switch 28 selectively operable by, for example, a spring-biased on-off push-button 29 mounted for access from the front of the book and preferably not covered by the front cover or any of the pages when in the closed position. By this arrangement the described powered motion of the objects by the drive mechanism can be selectively activated and deactivated, turned on and off, by a reader of the book.

An output shaft 25 of motor 24 supports a worm 27 in mesh with a main drive gear 30 and pulley 31 coaxially mounted upon the back cover casing. The motor 24, battery 26 and switch 28 are contained within a back cover compartment 32 positioned along an edge of the back cover. Though shown along the bottom edge of the back cover assembly 16, the back cover compartment 32 and associated components can equivalently be positioned along any edge of the back cover. An access panel 33 may be provided in the front or rear of the back cover compartment 32. A back cover panel 35, parallel to and spaced from the back cover plate 21, encloses and protects the drive mechanism within the back cover frame 17. A back cover page 19 overlies the back cover panel 35. In some embodiments, the back cover panel or page may be several layers thick in some areas, and objects which move relative to the back cover page are supported at different elevations by the drive mechanism, in order to position them closer to the plane of an overlying page where the objects are first revealed, as further described below.

A main drive belt 34 extends around drive pulley 31 and an outer pulley track 37 in a main drive wheel 36 also axially mounted on the back cover. A main push bar 38 is swivel mounted at one end upon a pin cam 39 which extends perpendicularly from the main drive wheel 36. An opposite end of the main push bar 38 is connected by a connecting pin 40*a* to one end of a secondary push bar 42. The connecting pin 40*a* extends perpendicularly through the back cover panel 35, through a directional slot 44*a*, which in this case is a curvilinear path, which pin 40*a* follows when displaced by the main push bar 38. An object 46*a*, such as the small facsimile of a spider as shown, or any other object or thing, is supported by connecting pin 40*a* proximate to the surface of the back cover page or panel, opposite the drive mechanism and associated drive bars. The complete path of directional slot 44*a* is encompassed by the corresponding cut-out area 20*a* in the back cover page 19, the pages 14 and optionally in the front cover 12. Alternatively, only portions of any directional slots may be exposed by cut-out areas of any particular intermediate pages or the front cover, whereby a displaceable object or objects may or may not appear within a corresponding cut-out area depending upon the position of the associated push bar.

An elongate guide slot 48 is provided in the secondary push bar 42 to receive a stationary guide pin 50 which extends perpendicularly from the back cover plate 21, and may be either integrally formed with the back cover plate or positioned in a pre-formed hole, as further described below. Another connecting pin 40*b* is provided at an end of push bar 42 opposite pin 40*a* to support another object 46*b* on an opposite side of the back cover panel and within another directional slot 44*b*, which may also be curvilinear since the secondary push bar 42 swivels about guide pin 50 as it is displaced by the main push bar 38. The complete path of directional slot 44*b* is partially or entirely encompassed by the corresponding cut-out area 20*b* in the back cover panel 35 and back cover page 19, corresponding cut-outs in one or more of the intermediate pages 14, and optionally in the front cover 12.

With continuing reference to FIG. 2, a connecting arm 52 extends laterally from the secondary push bar 42 and is connected at a distal end to a third push bar 54 by a swivel pin 53. The third push bar 54 is also provided with an elongate guide slot 55 which receives another stationary guide pin 50 which extends perpendicularly from the back cover plate 21. Another connecting pin 40*c* is supported by a distal end of the third push bar 54 to extend perpendicularly through the back cover in a third directional slot 44*c*, also in this case generally curvilinear. The complete path of directional slot 44*c* is entirely or partially encompassed by the corresponding cut-out area 20*c* in the back cover 16, in one or more of the intermediate pages 14, and optionally in the front cover 12. The path of any of the directional guide slots may be straight-line linear or curved, i.e., curvilinear, all of which are referred to herein generally as "linear", and generally characterized by following a straight or curved path from one end of the path to an opposite end of the path. The back cover page may be elevated or layered or increased in thickness in areas between certain of the directional guide slots, whereby the object or objects connected to the drive mechanism through such slots is supported at a higher elevation relative to a lower point of the back cover page, so that it is positioned closer to the plane of an intermediate page with a corresponding cut-out. This construction is particularly suited for versions of the book having a greater number of intermediate pages. A transparent layer (not shown) may be provided over the cut-out areas 20*a*–20*c* in the back cover panel 35 to encapsulate the objects 46*a*–46*c* within the back cover assembly and protect them.

As partially shown in phantom in FIG. 2, as the main drive wheel 36 is rotated by the drive mechanism in either direction, connecting pin 40*a* (and object 46*a*) is displaced by the main push bar 38 along directional slot 44*a*, connecting pin 40*b* (and object 46*b*) is displaced by secondary push bar 42 along directional slot 44*b*, and connecting pin 40*c* (and object 46*c*) is displaced by third push bar 54 along directional slot 44*c*. As visible through the corresponding cut-outs 20*a*–*c*, all three objects 46*a*–*c* are set into motion upon activation of the drive mechanism. With textual and graphical material which corresponds to the motion and activity of the objects upon the page, the book creates dynamic animation of the subject matter at multiple locations upon the page areas, and at varying dimensional depths. For example, as shown in FIG. 1, cut-out 20*a* may be formed in the back cover page 19, the pages 14 and the front cover 12. Cut-out 20*b* may be formed only in one of the pages 14 and in the back cover page 19. And cut-out 20*c* may be formed only in the back cover page 19. By this novel construction, the seriatim appearance of the displaceable objects in the spatially arranged cut-outs as the book is paged through brings an element of surprise and heightened entertainment to the reader. The permanent exposure of the activating push-button 29 at the front surface of the back cover compartment 32 enables selective activation of the drive mechanism irrespective of the positions of the front cover and any of the intermediate pages.

Figure 3:
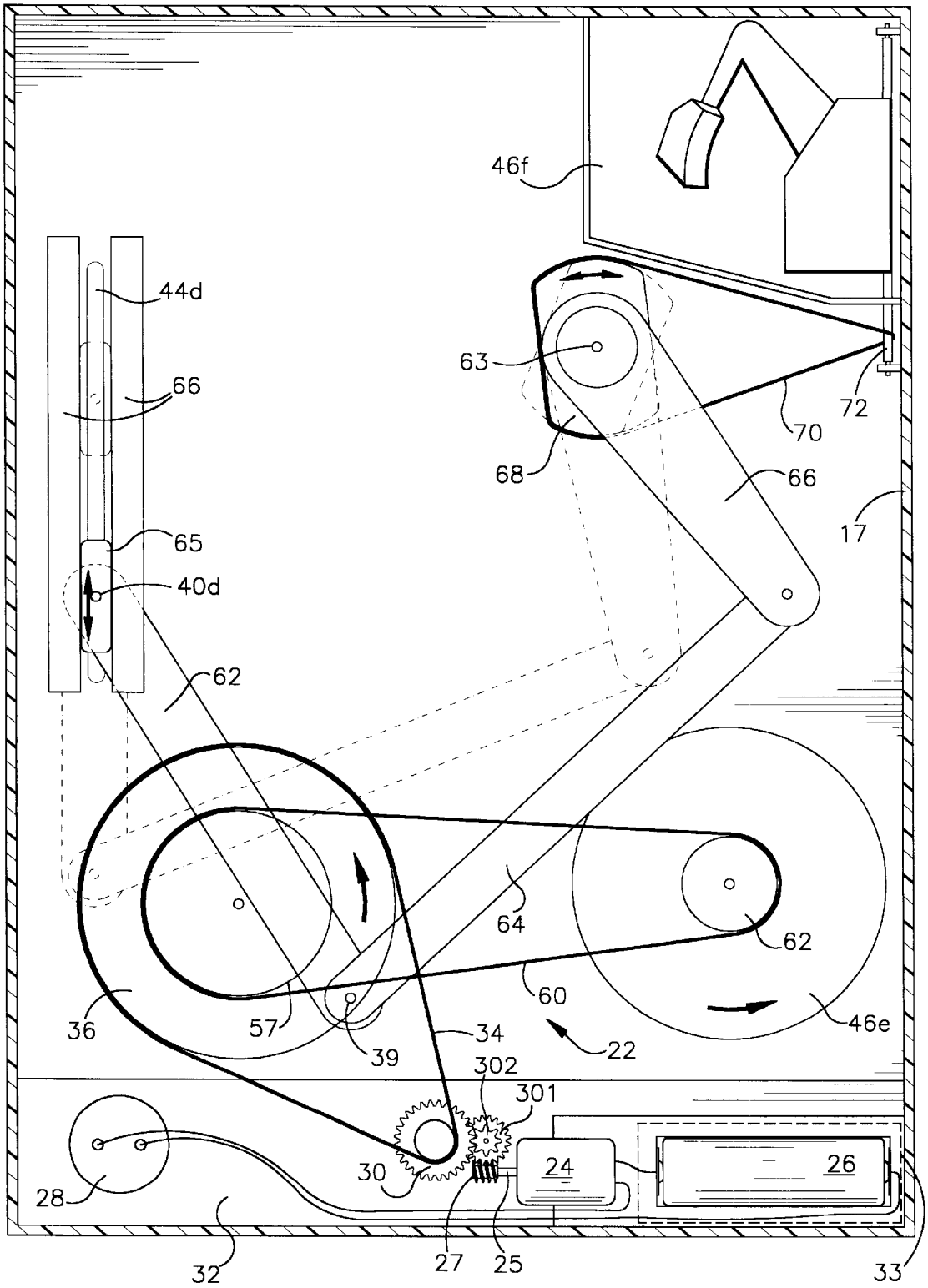
FIG. 3 is a plan view of an exterior side of a back cover structure and drive mechanism of an alternate embodiment of a mechanized book of the invention.
Figure 4A:
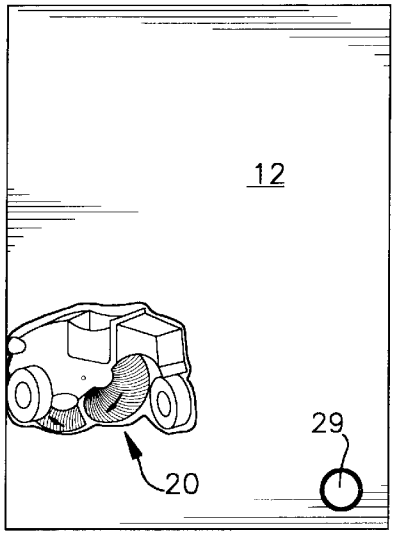
FIG. 4A is a plan view of the exterior side of a front cover of the mechanized book of the invention.
Figure 4C:
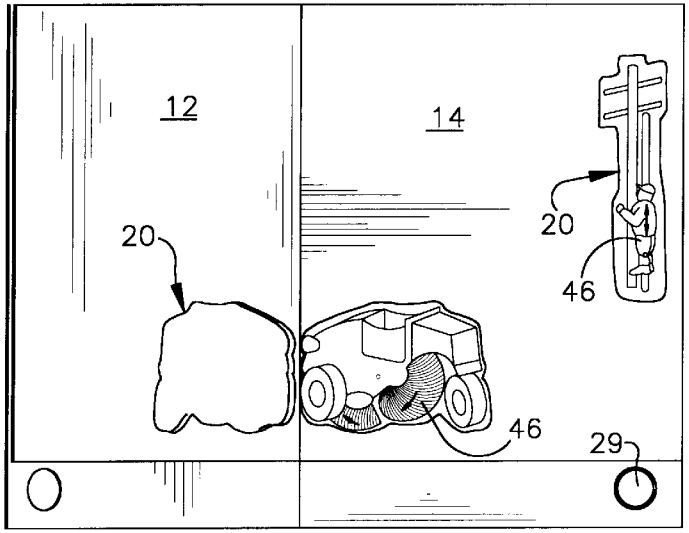
FIG. 4C is a plan view of two facing intermediate pages of the mechanized book of FIG. 4A.
Figure 4B:
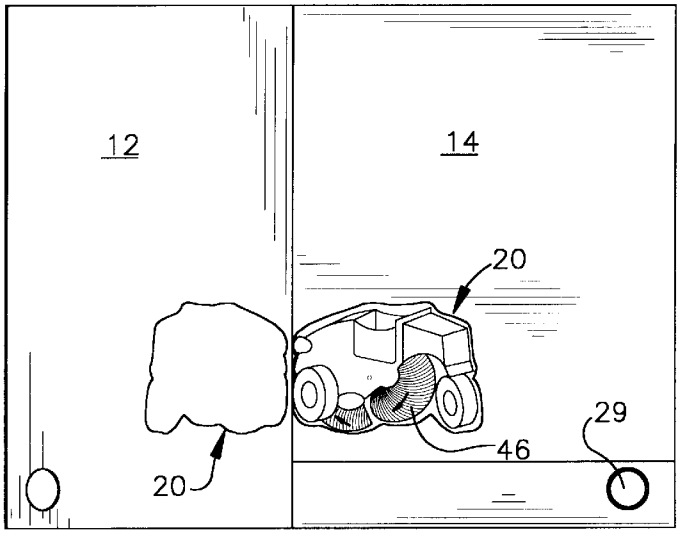
FIG. 4B is a plan view of an interior side of the front cover and an intermediate page of the mechanized book of FIG. 4A.
Figure 4D:
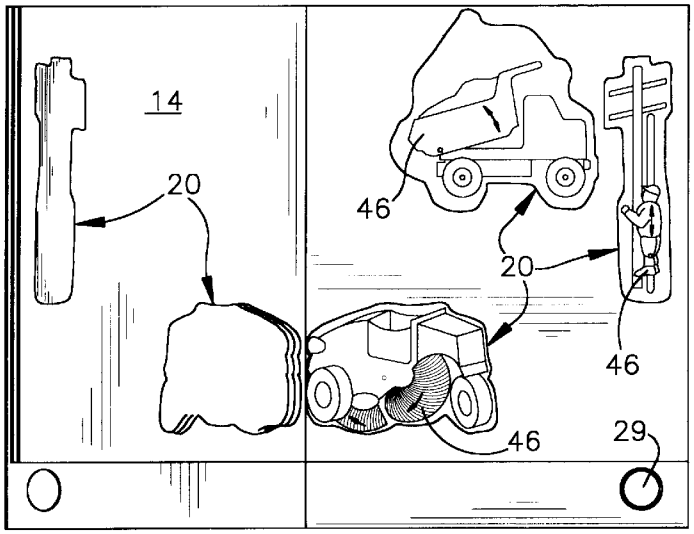
FIG. 4D is a plan view of two facing intermediate pages of the mechanized book of FIG. 4A.
Figure 4E:
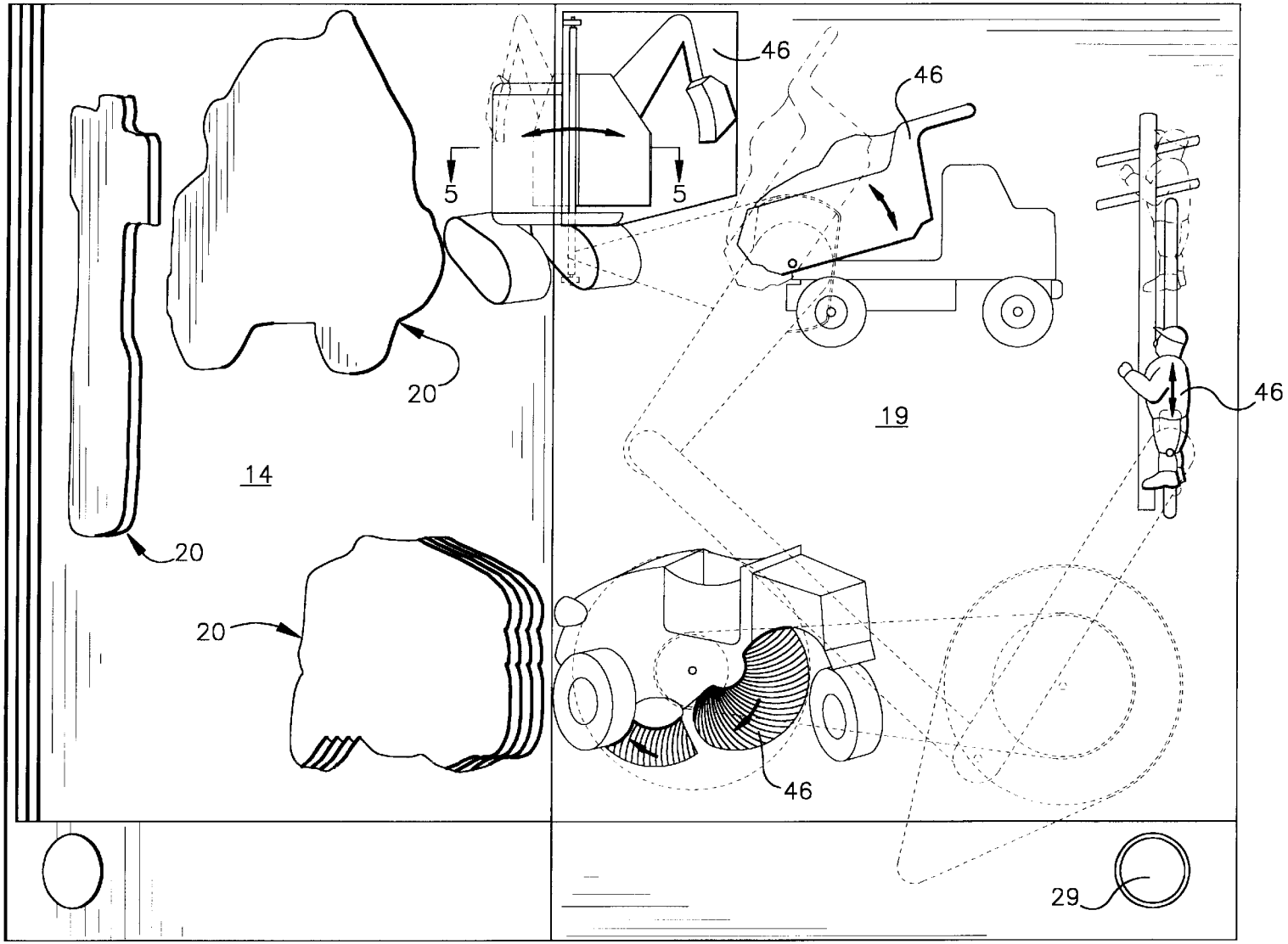
FIG. 4E is a plan view of an intermediate page and a back cover of the mechanized book of FIG. 4A.
Figure 5:
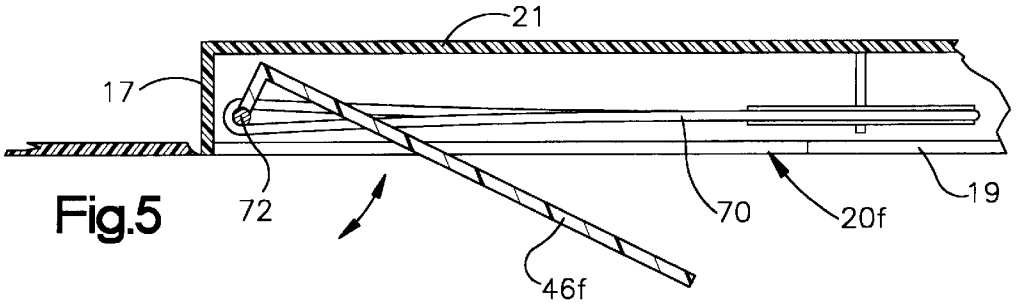
FIG. 5 is a cross-sectional view of the area of the back cover structure spanned by the arrows 5—5 in FIG. 4.

FIGS. 3–5 illustrate an alternate embodiment of a mechanized book constructed in accordance with the invention. The drive mechanism 22 shares certain common elements of the first described embodiment of a motor 24, battery 26, switch 28, motor shaft 25 and worm 27, main drive gear 30, drive pulley 31 and main drive wheel 36 connected by drive belt 34, and pin cam 39. Intermediate drive train gears 301 and 302 may be employed to achieve the most efficient driving ratios. The back cover assembly 16 similarly includes the back cover frame 17, back cover plate 21, the back cover compartment 32 with access panel 33, the back cover panel 35, and the back cover page 19.

In the embodiment of FIGS. 3–5, two main push bars 62 and 64 are connected to the pin cam 39 of the main drive wheel 36. An opposite end of push bar 62 is attached by a connecting pin 40*d* to a sliding element 65 captured between parallel guide walls 66 which straddle a generally linear directional slot 44*d*. The connecting pin 40*d* extends through the back cover page to support and translate an object 46*d* proximate and relative to the surface of the back cover page 19. Thus as the main drive wheel 36 is rotated in the direction indicated, push bar 62 is eccentrically displaced, reciprocally driving element 65 and object 46*d* along the linear path of slot 44*d*.

The main drive wheel 36 further includes an inner pulley track 57 which receives a second drive belt 60 engaged with a second pulley 62 attached to a rotating object 46*e* mounted upon a shaft which extends from the back cover casing. A graphical or textual image is applied to the side of the rotating object 46*e* opposite drive belt 60 to be viewed through a corresponding cut-out 20*e* in the back cover page 19. Of course, additional drive belts connected to additional pulleys and rotating objects can be combined to produce a combination of linear and rotary motions selectively activated by the drive mechanism. Belt drives are preferred in the invention for the inherent clutch-type slipping action afforded when the motor is activated with the objects physically restricted from movement, thus avoiding damage to any gear components. Complete encapsulation of the objects within the range of the directional guide slot will prevent such abuse. Thus, gear trains could be employed to rotate the main drive wheel.

Main push bar 64 is pivotally attached at one end to a rocker arm 66 mounted to pivot upon a pin 63 which extends perpendicularly from the back cover plate. The rocker arm 66 follows the eccentric of pin cam 39 as drive wheel 36 rotates, inducing angular oscillation of a block cam 68. A cam belt 70 extends about the periphery of the block cam 68 and about a post 72 permanently axially mounted upon the back cover casing. Displacement of the cam belt 70 by the angular oscillation of the block cam 68 causes axial rotation of the post 72 through approximately 180 degrees. An object 46*f* attached to radially extend from the post is thereby lifted out of the general plane of the back cover and the back cover page, as shown in FIG. 5, through a corresponding cut-out

20*f* in the back cover page, and through an approximate 180 degree range. As shown in FIG. 4, by positioning the post proximate and parallel to the book binding, the range of angular motion of object 46*f* extends from one page to a facing page. As also shown in FIG. 4, at least one additional object 46*g* can be connected to the block cam 68 to be displaced relative to the back cover page according to the angular oscillation of the block cam.

Figure 8:
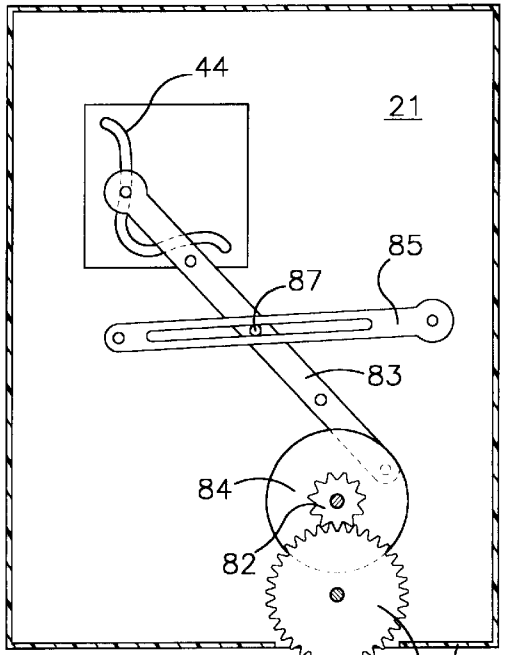
FIG. 8 is a plan view of a back cover structure and drive mechanism of a manually driven embodiment of the invention.
Figure 6:
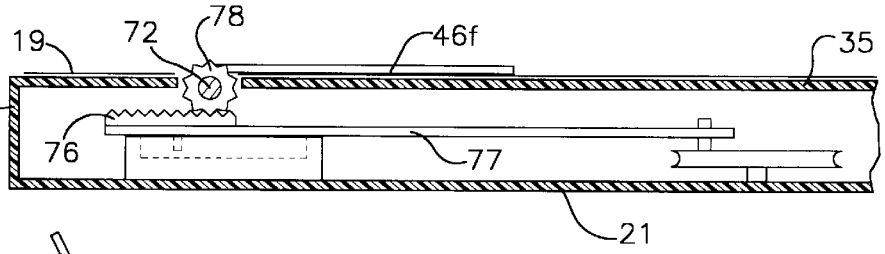
FIG. 6 is a cross-sectional view of parts of a drive mechanism and associated object displaceable relative to a back cover page in accordance with the invention.
Figure 7:
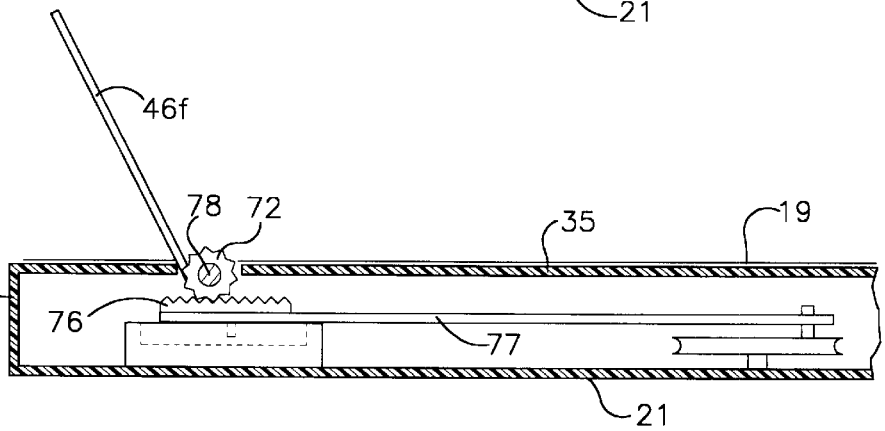
FIG. 7 is a cross-sectional view of the drive mechanism and displaceable object of FIG. 6 in a different position from FIG. 6.

As shown in FIGS. 6 and 7, the radial "fanning" motion of object 46*f* out of the plane of the page can alternatively be accomplished by a rack and pinion arrangement. A gear rack 76 is mounted upon an end of a push bar 77 which is journalled to reciprocate in a linear path in line and in mesh with a pinion gear 78 axially mounted upon an end of post 72. Object 46*f* is thereby elevated radially out of the plane of the page upon displacement of the rack 76 relative to the pinion gear 78. The rack 76 is displaced by the eccentric of the opposite end of the supporting push bar 77 connected to a drive wheel in a manner as previously described. Of course, the push bar 77 could be linearly indexed for manual displacement, by for example extending the bar out through the back cover frame 17. Similarly, any of the described rotary motions can be manually driven by positioning a geared drive wheel to partially traverse the back cover frame 17, as shown in FIG. 8. In this embodiment, a manual drive gear 80 is directly meshed with a smaller spur gear 82 which rotates a cam 84. One end of a push bar 83 is attached to cam 84, and an opposite end reciprocally carries an object along a directional slot. A second push bar 85, having an elongate slot 86 therein, intersects push bar 83 about a moving guide pin 87 which extends perpendicularly from push bar 83. One end of the second push bar 85 is attached to a fixed pivot point 88, while the opposite end is displaced according to the eccentric path of guide pin 87 on push bar 83.

Figure 10:
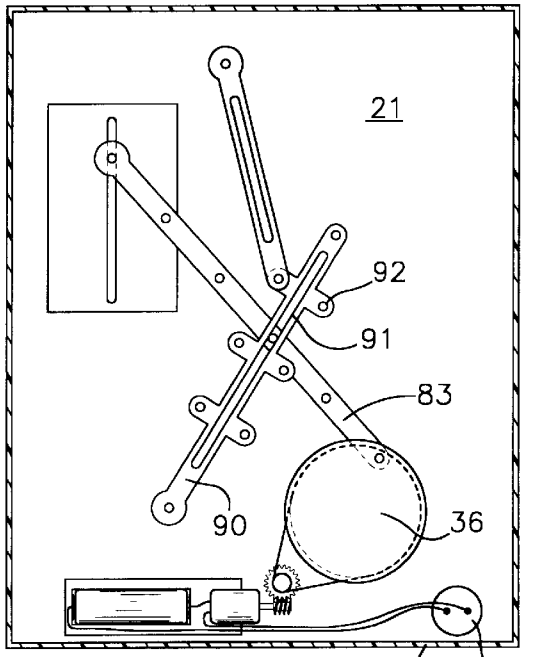
FIG. 10 is a plan view of a back cover structure and battery powered drive mechanism of an alternate embodiment of the invention.
Figure 9:
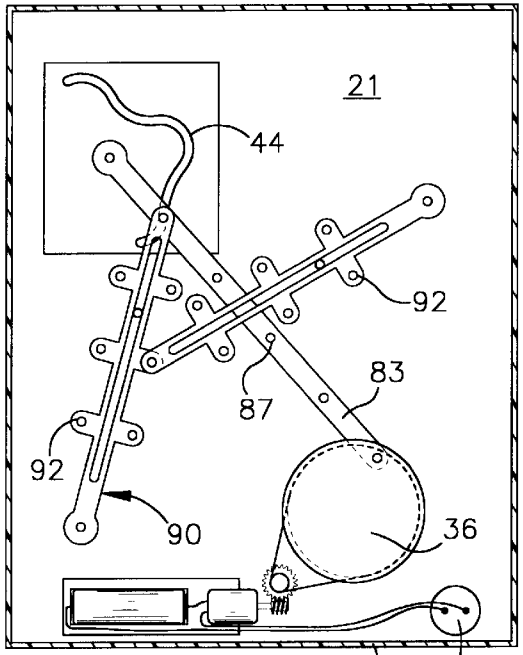
FIG. 9 is a plan view of a back cover structure and battery powered drive mechanism of an alternate embodiment of the invention.

FIGS. 9 and 10 illustrate motorized versions of similar intersecting push bar combinations, and further utilizing universal push bars 90 which have elongate center slots 91 and multiple connecting pin attachment points 92. The ends of the universal push bars 90 are adapted to be pivotally secured to either permanent pins which extend from the back cover or supporting page, or to connecting pin attachment points of other bars. The main push bar may have multiple moving pin guides 87 about which the elongate center slots of the intersecting push bars can be placed.

Figure 11:
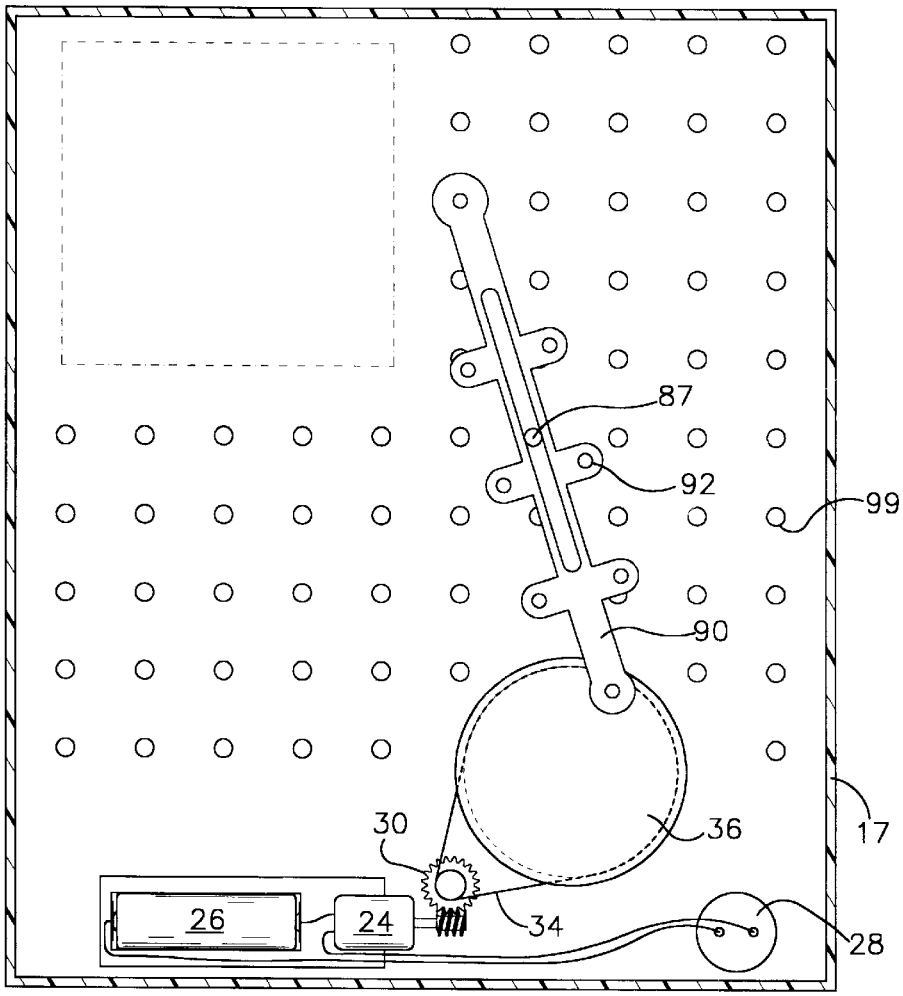
FIG. 11 is a plan view of a back cover structure and drive mechanism of an alternate embodiment of the invention.

The flexible configurations made possible by the universal push bars 92 for achieving reciprocating linear, non-linear and/or arcuate motion of objects supported by the push bars is further enhanced by providing a universal stationary pin mounting board as a part of the back cover assembly. As shown in FIG. 11, the back cover plate 21 can be formed with a matrix of pin or axle mounting holes 99 in the interior surface. With the main drive wheel 36 positioned near an edge of the matrix, there is made possible a multitude of arrangements of multiple push bars 90 mounted upon guide pins 87 which may be positioned within any of the holes 99, to move objects along associated directional slots in the overlying back cover panel. A universal back cover plate is thus provided for use with a book having any path or paths of motion for the objects.

Although the invention has been described with respect to certain preferred and alternate embodiments, variations and modifications of the general principles of the invention are within the scope and equivalent scope of the invention. For example and without limitation, geared drive mechanisms may be employed instead of drive belts and pulleys. Belt drives may be used in combination with directly meshed gear drive mechanisms. The push bars and connecting arms may have multiple lateral extensions which intersect other push bars, may be mounted upon multiple pivot points, and support additional objects at the ends and at intermediate points. The entire structure of the back cover assembly 16, including the drive mechanism, power source, and associated displaceable objects, may be incorporated into separate pages. This type of embodiment is particularly suited for execution in micro, with gears and pulleys the approximate size of coins, and a miniaturized power source such as wafer-style batteries. Or, a common drive element such as a worm drive may be axially mounted along the book binding, in mesh with elements of individual drive mechanisms in each page. Flexible electrical connections can be employed between each of the pages and the binding to enable selective activation of motion on any particular page driven by the common drive. Or, the main worm drive may be connected to a knob at the top or bottom of the binding for manually driving the linked mechanisms. These and other variations which embody the basic principles and concepts of the invention are all within the scope and equivalent scope of the accompanying claims.

What is claimed is:

1. A mechanized book comprising:

a front cover connected along a binding to a back cover, intermediate pages connected to the binding and positioned between the front cover and the back cover, the back cover comprising a back cover casing, an exterior side of the back cover casing covered by a back cover plate, and an interior side of the back cover casing substantially covered by a back cover panel, the back cover panel facing the intermediate pages between the front cover and back cover, a drive mechanism supported by the back cover casing, the drive mechanism including elements which support and displace objects relative to the back cover panel, openings in the back cover panel through which objects displaced by the drive mechanism are visible and within which objects displaced by the drive mechanism move, the openings in the back cover panel being of a size at least equal to a range of motion of a corresponding object, and openings in the intermediate pages which correspond in size with the openings in the back cover panel.

2. The mechanized book of claim 1 wherein the drive mechanism includes a motor operatively connected to a main drive wheel, the main drive wheel connected to at least one push bar, and wherein the push bar supports an object for movement relative to the back cover page.

3. The mechanized book of claim 1 wherein the drive mechanism includes multiple elements and multiple objects, and the intermediate pages include multiple cut-outs.

4. The mechanized book of claim 2 wherein the drive mechanism includes a motor operative to drive a belt connected to the main drive wheel.

5. The mechanized book of claim 4 wherein the motor is an electric motor powered by a battery.

6. The mechanized book of claim 1 wherein the drive mechanism includes an on-off switch.

7. The mechanized book of claim 6 wherein the drive mechanism is selectively actuatable by the on-off switch irrespective of a position of the front cover relative to the intermediate pages.

8. The mechanized book of claim 1 wherein the back cover panel comprises directional slots and the objects supported by the elements of the drive mechanism extend through the directional slots.

9. The mechanized book of claim 8 wherein openings in the intermediate pages correspond to the directional slots in the back cover panel.

10. The mechanized book of claim 1 wherein the front cover includes an opening which corresponds in size to an opening in the back cover panel and intermediate pages.

11. The mechanized book of claim 1 wherein the drive mechanism displaces an object in a rotary motion.

12. The mechanized book of claim 1 wherein the drive mechanism displaces an object in a generally linear motion.

13. The mechanized book of claim 1 wherein the drive mechanism displaces an object in a generally curvilinear motion.

14. The mechanized book of claim 1 wherein an object is displaced by the drive mechanism in a path which extends out of a plane of the back cover panel.

15. The mechanized book of claim 2 comprising an opening in the front cover or intermediate pages which corresponds to the main drive wheel of the drive mechanism.

16. A mechanized book comprising a front cover, intermediate pages and a back cover connected together along a common edge, and a motorized mechanism supported by the back cover and connected to objects and operable to move the objects in relation to the back cover, intermediate pages and front cover upon actuation of the motorized mechanism and, openings in the back cover through which objects displace by the motorized mechanism are visible and within which the objects move, the openings in the back cover being of a size at least equal to a range of motion of a corresponding object and wherein the motorized mechanism includes an electric motor, a power source connected to the motor, and a main drive wheel driven by the motor.

17. The mechanized book of claim 16 wherein the main drive wheel is driven by a belt which is driven by the motor.

18. The mechanized book of claim 16 further comprising a rotating object axially mounted upon the back cover and rotatable by a belt driven by the main drive wheel.

19. The mechanized book of claim 18 further comprising an opening in the front cover or at least one of the intermediate pages which corresponds to the rotating object.

20. The mechanized book of claim 16 wherein the motorized mechanism includes a push bar connected to the main drive wheel and to an object.

21. The mechanized book of claim 16 wherein an object is connected to a push bar by a connecting pin.

22. The mechanized book of claim 16 wherein the motorized mechanism is selectively actuatable independent of relative positions of the front cover, intermediate pages and back cover.

23. The mechanized book of claim 16 further comprising an opening in the front cover which corresponds in size to openings in the intermediate pages.

24. The mechanized book of claim 16 wherein the motorized mechanism is operative to move at least one object in a generally linear path, and to move at least one object in a generally curvilinear path.

25. The mechanized book of claim 16 wherein the motorized mechanism is operative to move an object out of a plane of the back cover of the book.

26. The mechanized book of claim 18 wherein the motorized mechanism is operative to move an object in a linear path and to move a rotating element in a rotary path.

27. The mechanized book of claim 25 wherein the motorized mechanism is further operative to move an object in a linear path, and to move another object in a rotary path.

28. An automated book having an electrically powered mechanism for selectively setting objects into motion relative to pages of the book, the book comprising a front cover, a back cover, and intermediate pages between the front cover and back cover, the back cover supporting the electrically powered mechanism, objects positioned on an exposed side of the back cover and connected to the electrically powered mechanism, linear directional slots in the back cover through which the objects travel upon activation of the electrically powered mechanism, and a rotary object rotated by the electrically powered mechanism and visible through an opening in the back cover.

29. The automated book of claim 28 wherein the linear directional slots are generally straight.

30. The automated book of claim 28 wherein the linear directional slots are generally curved.

31. The automated book of claim 28 wherein the back cover has different elevations at which the objects are supported by the electrically powered mechanism.

32. The automated book of claim 28 further comprising openings in the intermediate pages which surround the linear directional slots.

33. The automated book of claim 28 wherein the electrically powered mechanism comprises an electrical motor, a power source, and gears connected to an output shaft of the motor.

34. The automated book of claim 28 wherein the rotary object is a main drive wheel of the electrically powered mechanism.

35. The automated book of claim 33 wherein the rotary object is driven by a belt connected to a gear connected to the output shaft of the motor.

36. The automated book of claim 28 further comprising an object mounted on the back cover for rotation out of a general plane of the back cover upon actuation by the electrically powered mechanism.

37. The automated book of claim 36 wherein an object is mounted on a post in the general plane of the back cover, and a belt extends from the post to an oscillating block cam attached to the electrically powered mechanism.

38. A mechanized book having objects which move in relation to pages of the book, the book comprising a front cover attached to a back cover assembly, and intermediate pages between the front cover and the back cover assembly, the back cover assembly comprising a frame surrounding a back cover plate and a back cover panel, the back cover panel parallel to and spaced from the back cover plate, an exterior side of the back cover panel facing the intermediate pages, a drive mechanism within the back cover assembly, the drive mechanism including a motor connected to members, directional guide slots in the back cover panel, and objects on the exterior side of the back cover panel connected by connecting pins which extend through the back cover panel to members of the drive mechanism, the directional guide slots defining a linear path which an intersecting connecting pin and connected object follows when a corresponding member of the drive mechanism is put into motion by the drive mechanism motor, whereby an object travels a linear path relative to the back cover panel, and at least one opening in an intermediate page which corresponds to a directional guide slot.

39. The mechanized book of claim 38 further comprising a back cover page attached to the interior side of the back cover panel.

40. The mechanized book of claim 38 further comprising a rotary member connected to the drive mechanism, and an opening in the back cover panel which corresponds to a position of the rotary member.

41. The mechanized book of claim 38 further comprising an object mounted for rotation out of a plane of the back cover panel, and connected to the drive mechanism which is operable to move the object out of the plane of the back cover panel.

42. The mechanized book of claim 38 wherein the drive mechanism comprises an electric motor selectively operable independent of positions of the front cover and intermediate pages relative to the back cover assembly.

* * * * *